US009232826B2

(12) United States Patent
Vermillion

(10) Patent No.: US 9,232,826 B2
(45) Date of Patent: Jan. 12, 2016

(54) CLIP FOR HARD HAT

(71) Applicant: Bradley N. Vermillion, Highlands, TX (US)

(72) Inventor: Bradley N. Vermillion, Highlands, TX (US)

( * ) Notice: Subject to any disclaimer, the term of this patent is extended or adjusted under 35 U.S.C. 154(b) by 249 days.

(21) Appl. No.: 13/959,869

(22) Filed: Aug. 6, 2013

(65) Prior Publication Data

US 2015/0040297 A1 Feb. 12, 2015

(51) Int. Cl.
*A42B 3/04* (2006.01)

(52) U.S. Cl.
CPC ..... *A42B 3/0406* (2013.01); *A42B 3/04* (2013.01); *Y10T 24/1394* (2015.01)

(58) Field of Classification Search
CPC ..... A42B 1/06; A42B 1/068; A42B 1/24; A42B 1/244; A42B 1/247; A42B 1/248; A42B 3/0406; A42B 3/04; Y10T 24/1394
See application file for complete search history.

(56) References Cited

U.S. PATENT DOCUMENTS

| | | | | | |
|---|---|---|---|---|---|
| 1,392,409 | A | * | 10/1921 | Fullenwider | 131/257 |
| 2,434,076 | A | * | 1/1948 | Kilham | 2/10 |
| 2,733,492 | A | | 2/1956 | Copell | |
| 4,179,753 | A | * | 12/1979 | Aronberg et al. | 2/10 |
| 4,193,133 | A | | 3/1980 | Laibach et al. | |
| 4,276,657 | A | | 7/1981 | Montesi | |
| 5,829,103 | A | | 11/1998 | Allen | |
| 5,867,874 | A | | 2/1999 | Simpson | |
| 6,185,748 | B1 | * | 2/2001 | DeChambeau | 2/195.1 |
| 6,481,059 | B2 | | 11/2002 | Morris | |
| 7,703,938 | B1 | * | 4/2010 | Brown, Jr. | 362/106 |
| 2005/0108857 | A1 | * | 5/2005 | Wartian et al. | 24/10 R |
| 2007/0024805 | A1 | * | 2/2007 | Sasaki | 351/47 |
| 2008/0295295 | A1 | * | 12/2008 | Rogers | 24/3.12 |
| 2010/0212066 | A1 | * | 8/2010 | Gilman | 2/209.13 |
| 2010/0254123 | A1 | | 10/2010 | Brown | |
| 2011/0113529 | A1 | | 5/2011 | Milioto | |
| 2015/0055327 | A1 | * | 2/2015 | Mascitti | 362/106 |

OTHER PUBLICATIONS

Franklin Fibre-Lamitex Corp, "Goggle Clip Orange Fits Full Brim" Apr. 5, 2012 http://gosafe.com/ProductDetails.aspx?pid=FRAKYM=KYOH&retUrl=.
Franklin Fibre-Lamitex Corp, "Goggle Clip White Fits on Cap" Apr. 5, 2012 http://gosafe.com/ProductDetails.aspx?pid=FRAKYM=KYWC%20&guid=e6b19fdd- . . . .

* cited by examiner

*Primary Examiner* — Shaun R Hurley
*Assistant Examiner* — Andrew W Sutton
(74) *Attorney, Agent, or Firm* — John R. Casperson

(57) ABSTRACT

A generally "S" shaped clip is formed from a band of resilient material having a first end a second end. The clip has a front side and a back side. The front side of the "S" shape corresponds to the back side of the clip. The back side of the "S" shape corresponds to the front side of the clip. The clip has an upper end and a lower end. The band of material is doubled back on itself at the lower end of the clip in the direction of the back side of the clip to form a slot for receipt of a projecting edge of a hat. An upper portion of the clip forms a curved clasping arm for securing objects against a crown portion of a hat.

15 Claims, 2 Drawing Sheets

CLIP FOR HARD HAT

FIELD OF THE INVENTION

In one aspect, this invention relates to a clip for retaining articles. In another aspect, the invention relates to a clip/hard hat assembly that can retain articles, such as safety glasses, on the hard hat. In another aspect, the invention relates to a method of modifying a hard hat so that it can carry articles such as safety glasses.

BACKGROUND OF THE INVENTION

A worker's eyes are often the most at-risk of bodily parts. Eyes are easily injured, and easily permanently injured. A worker's loss of vision can also lead to loss of life.

Eyesight is easily protected to some extent with safety glasses. However, as anyone who has worn them knows, they are easily misplaced. A worker's inability to quickly locate their safety glasses leads to wasted time, and can possibly tempt them to take chances with their vision by not donning glasses. A device that guards against misplaced glasses would be very desirable.

OBJECTS OF THE INVENTION

It is an object of this invention to protect against eye injuries.

It is another object of this invention to reduce the incidence of misplacement of safety glasses by providing a convenient place to put them.

It is a further object of this invention to provide a device for securing safety glasses.

SUMMARY OF THE INVENTION

One embodiment of the invention provides a generally "S" shaped clip formed from a band of resilient material having a first end a second end. The clip has a front side and a back side. The front side of the "S" shape corresponds to the back side of the clip. The back side of the "S" shape corresponds to the front side of the clip. The clip has an upper end and a lower end. The band of material is doubled back on itself at the lower end of the clip in the direction of the back side of the clip to form a slot for receipt of a projecting edge of a hat. An upper portion of the clip forms a curved clasping arm for securing objects against a crown portion of a hat.

DETAILED DESCRIPTION OF THE INVENTION

Figure 1:
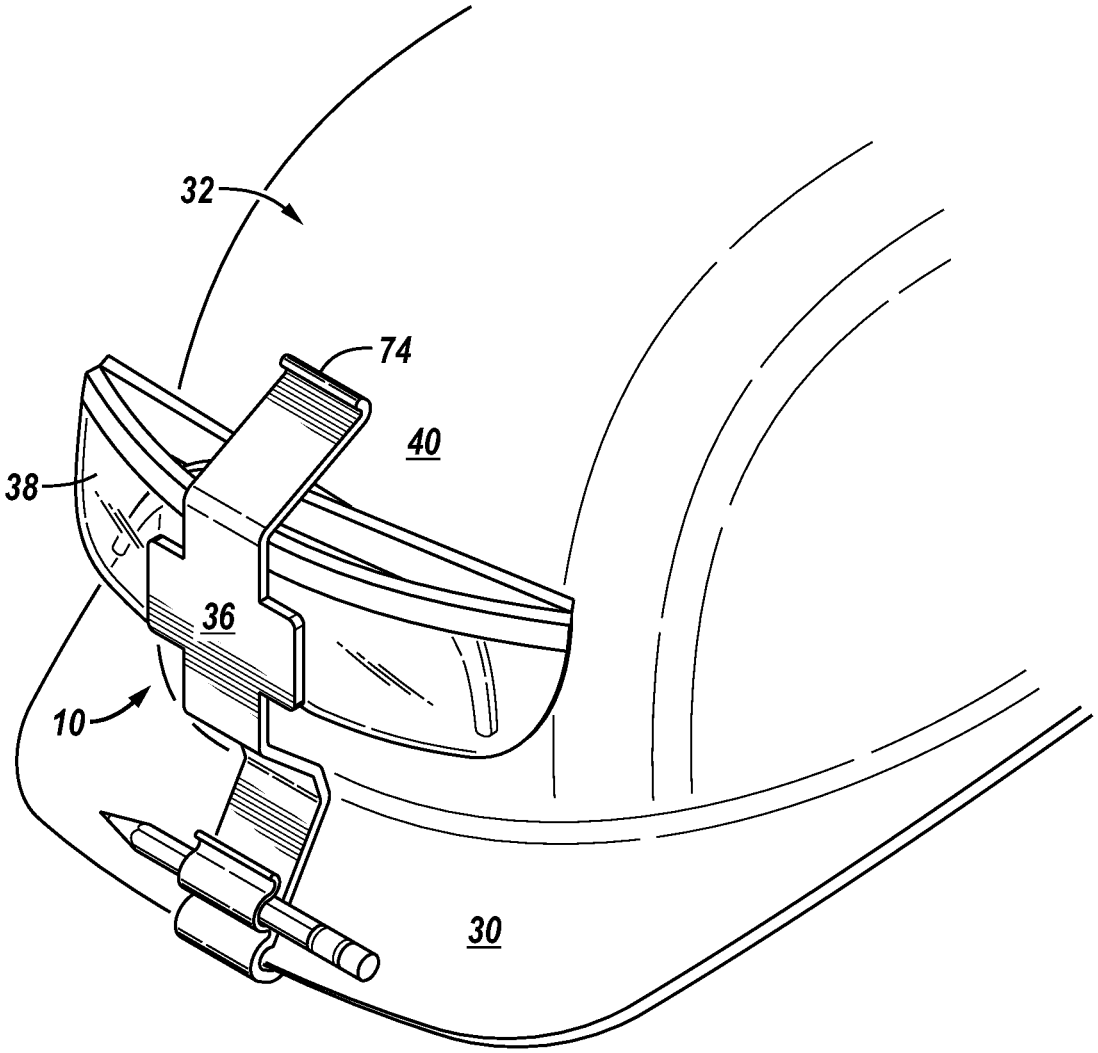
FIG. 1 is a pictorial illustration of one embodiment of the invention.
Figure 2:
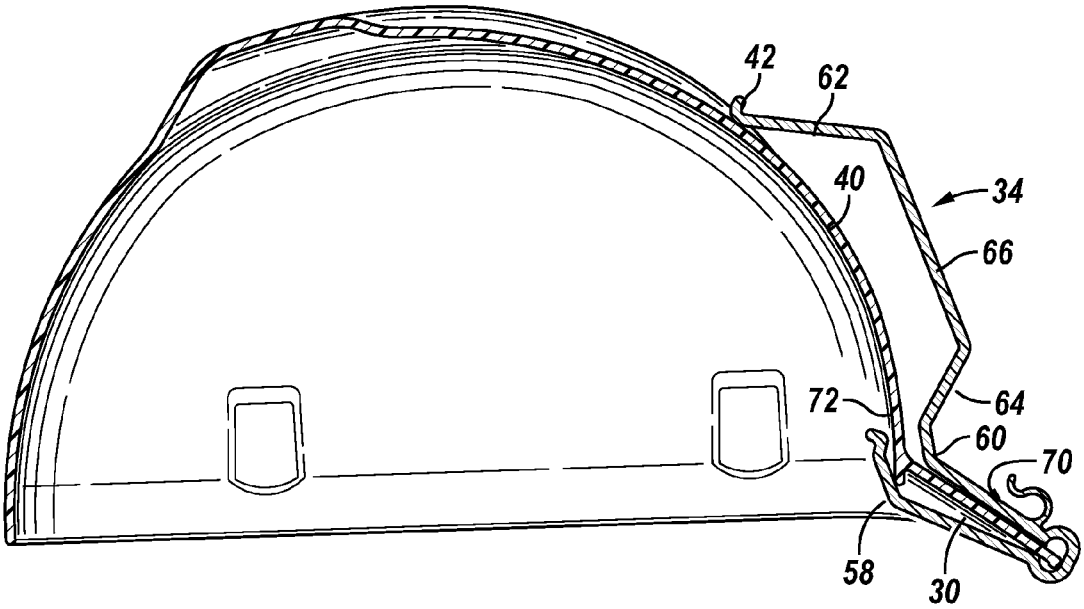
FIG. 2 is a cross-sectional view of a portion of the invention shown in FIG. 1.
Figure 3:
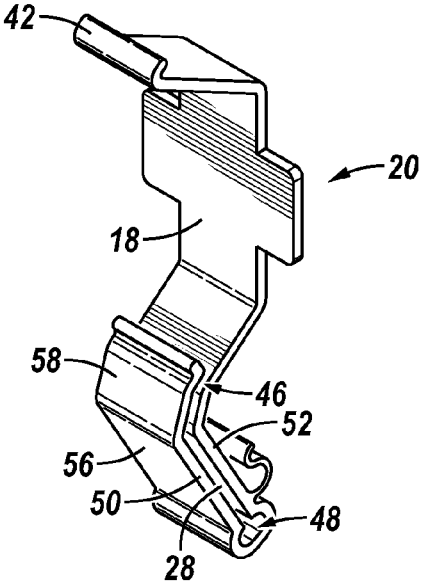
FIG. 3 is a pictorial illustration of a portion of the invention shown in FIG. 2.
Figure 4:
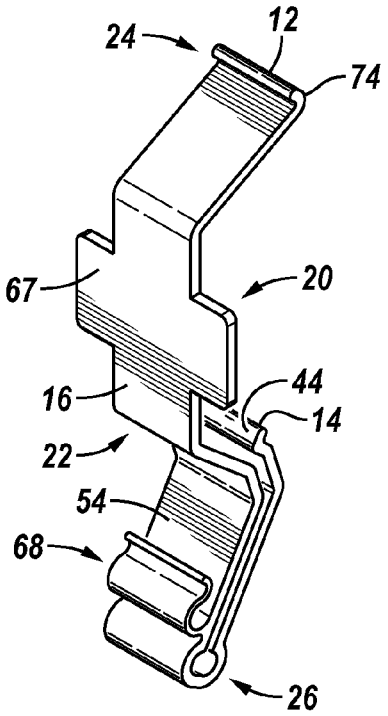
FIG. 4 is a reverse view of the invention shown in FIG. 3.

A generally "S" shaped clip 10 is formed from a band of resilient material having a first end 12 a second end 14. The clip has a front side 16 and a back side 18. The front side 20 of the "S" shape corresponds to the back side of the clip. The back side 22 of the "S" shape corresponds to the front side of the clip. The clip has an upper end 24 and a lower end 26. The band of material is doubled back on itself at the lower end of the clip in the direction of the back side of the clip to form a slot 28 for receipt of a projecting edge 30 of a hat 32. An upper portion 34 of the clip forms a curved clasping arm 36 for securing objects 38 against a crown portion 40 of the hat.

Preferably, the clip has a lip 42 at the upper end protruding generally away from the front side of the clip to facilitate manually prying the upper portion of the clip away from the crown portion of the hat. A lip 44 is positioned at the second end of the band protruding generally away from the back side of the clip to facilitate opening the slot to receive the projecting edge of the hat.

Preferably, the slot has an upper end 46 and a lower end 48 and is enlarged at the lower end to provide the slot with a generally keyhole-shaped cross section to engage a projecting edge of a hat that has an enlarged periphery. A pair of opposed generally parallel, generally flat, sections of the band 50, 52 define a major portion of the slot.

In the illustrated embodiment, the pair of flat sections comprises a first section 54 of the band that is generally flat extending along the front side of the clip and a second section 56 of the band that is generally flat section extending along a back side of the clip. A third section 58 of the band connects the lip at the second end of the band with the second section of the band. The third section of the band is preferably generally flat and connects to the second section of the band at an inside angle in the range of 120 degrees to 150 degrees.

The clip preferably further comprises a fourth section 60 of the band which is generally flat and connects to the first section of the band at an inside angle in the range of 120 degrees to 150 degrees, said fourth section of the band extending generally alongside the third section of the band. The fourth section of the band connects to the upper portion of the clip.

The upper portion of the clip preferably has an open generally trapezoidal cross section formed by an upper leg section 62, a lower leg section 64, and a roof section 66 connecting the upper leg section to the lower leg section. The lip at the upper end of the clip preferably extends angularly from the upper end of the upper leg. The roof section preferably has a central section 67 that is widened. Preferably, the central section is rectangularly shaped, and is used for carrying printed matter.

In a most preferred embodiment of the invention, the clip further comprises a tongue element section 68 extending across the first flat section of the clip and protruding outwardly and upwardly from the front surface of the clip. The tongue element section, in combination with the first flat section, forms a trough 70 extending across the front surface of the clip. An inside bottom end of the trough is enlarged and concavely rounded for receipt of an elongated writing implement. An inside middle portion of the trough is narrowed and convexly rounded for retention of an elongated writing implement closely received at the bottom end of the trough.

The clip is preferably used in combination, a hard hat 32 having a crown portion 40 having a front side, a back side, an inside surface, and an outside surface. The hard hat has a projecting edge 40 extending outwardly from a lower edge of at least the front side of crown portion. The projecting edge is received by the slot of the clip.

The third section 58 of the band preferably contacts an inside surface 72 of the hard hat and biases the upper portion of the clip towards the outside surface of the crown portion of the hard hat. Preferably, an elbow 74 connects the upper lip of the clip with the upper leg of the portion of the clip having trapezoidal cross section. The elbow contacts the outside surface of the crown portion of the hard hat when the clip is not being used to hold protective safety eyewear. Preferably, however, the combination is used to clasp safety eyewear against the front side of the crown portion of the hard hat. More preferably, the combination is used to retain an elongated writing implement closely received at the bottom of the trough.

One embodiment of the invention is used by positioning the slot of the clip on a projecting edge of a hard hat. The invention can be further used by latching the clip to the hard hat by positioning the third section of the band against and inside surface of the hard hat.

The clip can be formed entirely from a polymeric material, such as a polyetheretherketone via an injection molding process.

While certain preferred embodiments have been described herein, the invention is not to be construed as being so limited, except to the extent that such limitations are found in the claims.

What is claimed is:

1. A generally "S" shaped clip formed from a band of resilient material, said band having a first end a second end, said clip having a front side and a back side, with the front side of the "S" corresponding to the back side of the clip, and the back side of the "S" corresponding to the front side of the clip, said clip having an upper end and a lower end, the band of resilient material being doubled back on itself in a bend at the lower end of the clip in the direction of the back side of the clip, said band of resilient material extending alongside the front side of the S shape from the bend and terminating at the second end of the band, said band of resilient material being spaced from the front side of the S shape to form a slot for receipt of a projecting edge of a hard hat, an upper portion of the clip beginning across from the second end of the band and extending to the first end of the clip, said upper portion of the clip forming a curved clasping arm for securing objects against a crown portion of the hard hat by clasping said objects between the curved clasping arm and the crown portion of the hard hat.

2. A clip as in claim 1 wherein the clip has a lip at the upper end protruding generally away from the front side of the clip to facilitate manually prying the upper portion of the clip away from the crown portion of the hard hat, and a lip at the second end of the band protruding generally away from the back side of the clip to facilitate opening the slot to receive the projecting edge of the hard hat.

3. A clip as in claim 1 wherein the slot has an upper end alongside the second end of the band and a lower end alongside the bend and is enlarged at the lower end to provide the slot with a generally keyhole-shaped cross section to engage a projecting edge of a hard hat that has an enlarged periphery.

4. A clip as in claim 1 wherein a pair of opposed generally parallel, generally flat, sections of the band define a major portion of the slot.

5. A clip as in claim 4 wherein the pair of flat sections consist of a first section of the band which is generally flat extending along the front side of the clip and a second section of the band which is generally flat section extending along a back side of the clip.

6. A clip as in claim 5 further comprising a third section of the band connecting the lip at the second end of the band with the second section of the band.

7. A clip as in claim 2 where the upper portion of the clip has an open generally trapezoidal cross section formed by an upper leg section, a lower leg section, and a roof section connecting the upper leg section to the lower leg section.

8. A clip as in claim 5 further comprising a tongue element section extending across the first flat section of the clip and protruding outwardly and upwardly from the front surface of the clip to define, in combination with the first flat section, a trough extending across the front surface of the clip.

9. A clip as in claim 8 wherein an inside bottom end of the trough is enlarged and concavely rounded for receipt of a writing implement.

10. A clip as in claim 9 wherein an inside middle portion of the trough is narrowed and convexly rounded for retention of a writing implement closely received at the bottom end of the trough.

11. A clip as in claim 1 further comprising, in combination, a hard hat having a crown portion having a front side, a back side, an inside surface, and an outside surface, and a projecting edge extending outwardly from a lower edge of at least the front side of crown portion, said projecting edge being received by the slot.

12. A combination as in claim 11 wherein the slot has an upper end and a lower end and is enlarged at the lower end to provide the slot with a generally keyhole-shaped cross section to engage a projecting edge of a hat that has an enlarged periphery, wherein a pair of opposed generally parallel, generally flat, sections of the band define a major portion of the slot, wherein the pair of flat sections comprise a first section of the band which is generally flat extending along the front side of the clip and a second section of the band which is generally flat section extending along a back side of the clip, said clip further comprising a third section of the band connecting the lip at the second end of the band with the second section of the band, wherein the third section of the band connects to the second section of the band at an inside angle in the range of 120 degrees to 150 degrees, wherein the third section of the band contacts an inside surface of the hard hat and biases the upper portion of the clip towards the outside surface of the crown portion of the hard hat.

13. A combination as in claim 11, further comprising a safety eyewear clasped by the clip against the front side of the crown portion of the hard hat, between the arm and the hard hat.

14. A clip as in claim 8, further comprising, in combination, an elongated writing implement closely received at the bottom of the trough.

15. A method comprising providing a generally "S" shaped clip formed from a band of resilient material, said band having a first end a second end, said clip having a front side and a back side, with the front side of the "S" corresponding to the back side of the clip, and the back side of the "S" corresponding to the front side of the clip, said clip having an upper end and a lower end, the band of resilient material being doubled back on itself in a bend at the lower end of the clip in the direction of the back side of the clip, said band of resilient material extending alongside the front side of the S shape from the bend and terminating at the second end of the band, said band of resilient material being spaced from the front side of the S shape to form a slot for receipt of a projecting edge of a hard hat, an upper portion of the clip beginning across from the second end of the band and extending to the first end of the clip, said upper portion of the clip forming a curved clasping arm for securing objects against a crown portion of the hard hat by clasping said objects between the curved clasping arm and the crown portion of the hard hat, providing a hard hat having a projecting leading edge a crown portion having a front side, and an inside surface, positioning the slot of the clip on the projecting edge of the hard hat, latching the clip to the hard hat by positioning the third section of the band against the inside surface of the hard hat, providing a safety eyewear, and clasping the safety eyewear against the front side of the crown portion of the hard hat, between the arm and the hard hat.

* * * * *